United States Patent [19]

Nagel

[11] Patent Number: 4,758,701

[45] Date of Patent: Jul. 19, 1988

[54] INDICATOR LIGHT ASSEMBLY FOR CONTROL PANEL

[75] Inventor: Robert I. Nagel, Mesa, Ariz.

[73] Assignee: Allen-Bradley Company, Milwaukee, Wis.

[21] Appl. No.: 589,569

[22] Filed: Mar. 14, 1984

[51] Int. Cl.[4] ..... H01H 9/18

[52] U.S. Cl. ..... 200/314; 200/311

[58] Field of Search ..... 200/310–311, 200/313–317; 350/451–452

[56] References Cited

U.S. PATENT DOCUMENTS

| | | | |
|---|---|---|---|
| 1,955,599 | 4/1934 | Lamblin-Parent | 350/452 |
| 2,334,479 | 11/1943 | Creager | 200/316 |
| 3,334,958 | 8/1967 | Appeldorn | 350/452 |
| 3,740,501 | 6/1973 | Kiessling et al. | 200/16 R |
| 3,770,925 | 11/1973 | Nelson et al. | 200/296 |
| 4,071,726 | 1/1978 | Werda | 200/311 |
| 4,146,306 | 3/1979 | Wallach | 350/452 |
| 4,254,317 | 3/1981 | Schlegel | 200/314 |
| 4,404,445 | 9/1983 | Baran et al. | 200/314 |

OTHER PUBLICATIONS

Dennis Vanderwerf, Approximating the Fresnel Lens, Feb. 1982, pp. 57–51.

*Primary Examiner*—Renee S. Luebke

*Attorney, Agent, or Firm*—Quarles & Brady

[57] ABSTRACT

An indicator light assembly forms part of a push button switch. A base member is formed from a transparent material having a high index of refraction. A shaft is formed on the back of the base member which cooperates with other switch elements and which defines a space in which an indicator lamp is mounted. A concave lens is formed on the back of the base member at the forward end of this space, and a Fresnel lens is formed on the front surface of the base member. A Fresnel plate is positioned over the front of the base member and the optical surfaces thus formed serve to uniformly disperse the light from the indicator lamp.

5 Claims, 2 Drawing Sheets

FIG.5
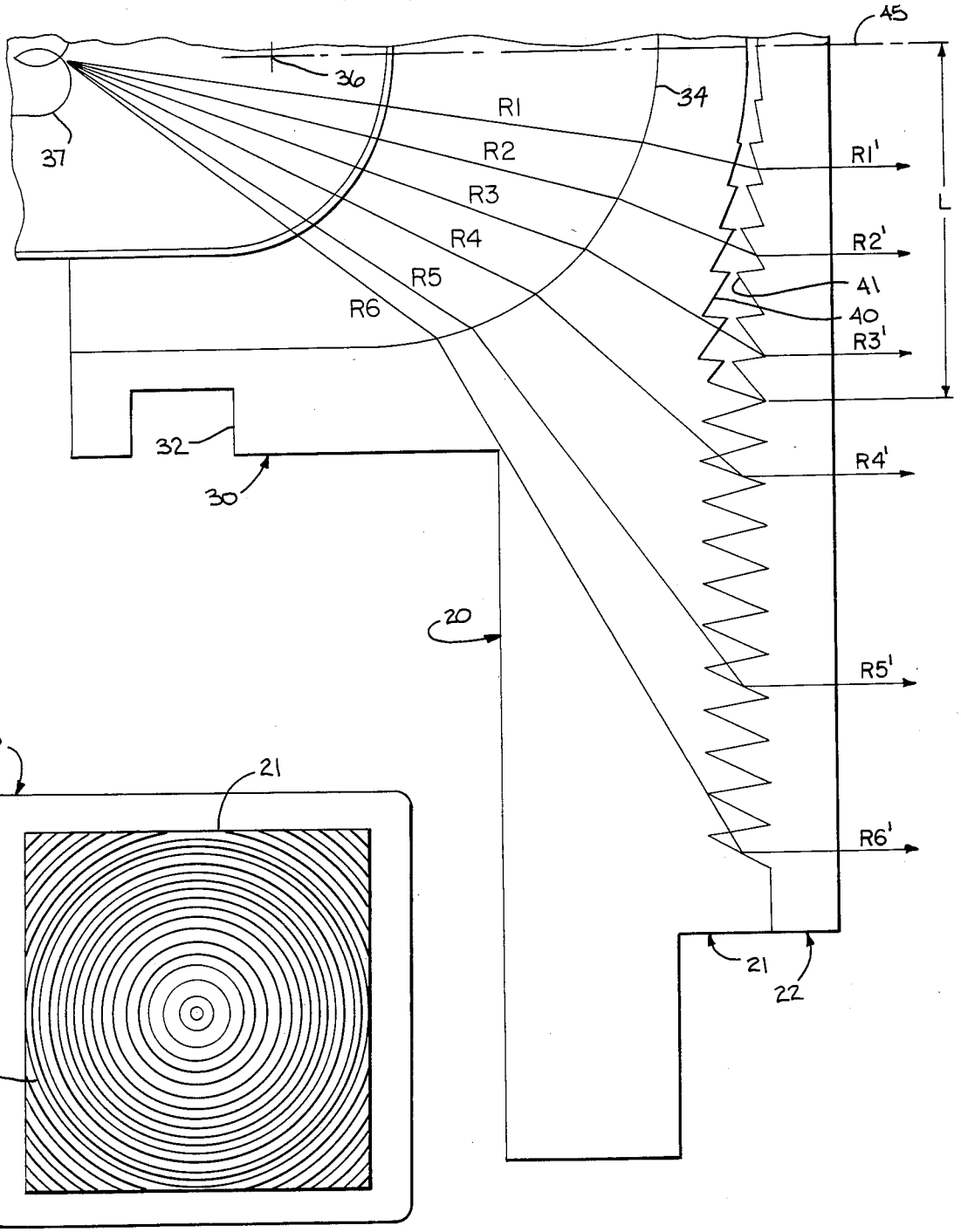
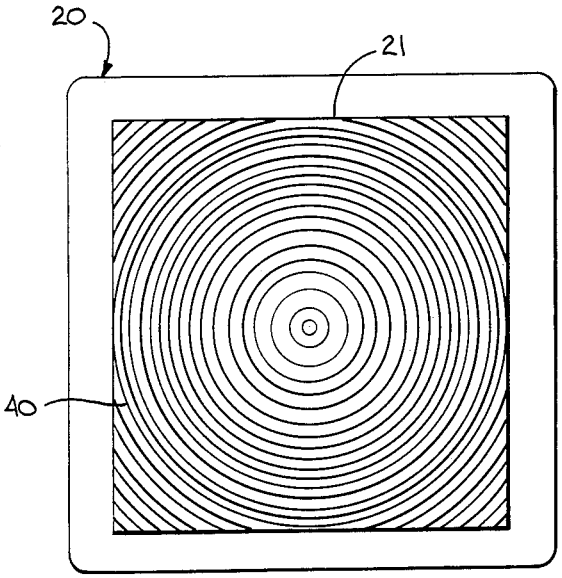
FIG. 4

INDICATOR LIGHT ASSEMBLY FOR CONTROL PANEL

BACKGROUND OF THE INVENTION

The field of the invention is indicator lights used on control panels for electrical equipment.

Indicator lights for control panels take many forms. Some indicator lights are separate devices, often referred to as "pilot lights", and others form part of electrical components such as push button switches and selector switches. The indicator light may merely illuminate an area on the control panel, or it may illuminate alpha-numeric characters or other symbols which convey a message to a human observer. It is important that the indicator disperse light relatively uniformly, and over a wide angle, so that the human operator may receive an accurate indication from any viewing angle.

Prior indicator lights typically attempt to achieve these objectives in one of two ways. First, they may use glass lenses which focus the light in a desired pattern, or second, they may employ a transparent or translucent light diffuser which scatters the light from the indicator in a random fashion. Glass lenses are expensive and neither of these approaches eliminates uneven illumination, or "hot spots", due to the reflection of light off the back surface of the lens or diffuser. These problems are exacerbated when physical constraints are placed on the location of the indicator light in devices such as push button switches.

SUMMARY OF THE INVENTION

The present invention relates to an indicator light assembly for use as a pilot light or as part of an electrical switch or other electrical component that is mounted to a control panel or display. More particularly, the indicator light assembly includes a lens formed from a material having a high index of refraction and having a concave surface which is directed rearward toward the light source and a front surface which is contoured to diffuse light which passes through the lens from the rear, and the light source is positioned to the rear of the focal point of the concave surface.

An object of the invention is to disperse the light from the source relatively uniformly over the entire front surface of the lens. The light from the source is refracted by the concave rear surface of the lens, but not reflected. The curvature of the concave surface and the position of the light source is such that the light is dispersed by refraction to the remote extremities of the lens. By reducing uncontrolled reflections, hot spots of intense light or dark spots of reduced light are eliminated. Instead, the light from the source passes directly into the lens and fans out substantially uniformly.

Another object of the invention is to emit the light from the front surface of the lens in all directions to provide a wide viewing angle for the human operator. This is accomplished by contouring the front surface of the lens with concentric grooves which present a myriad of prisms that function both to re-focus the light and diffuse the light.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 4 is a front view taken along the plane 4—4 shown in FIG. 3; and FIG. 5 is a schematic view of the indicator light assembly which shows the passage of light therethrough.

DESCRIPTION OF THE PREFERRED EMBODIMENT

Figure 1:
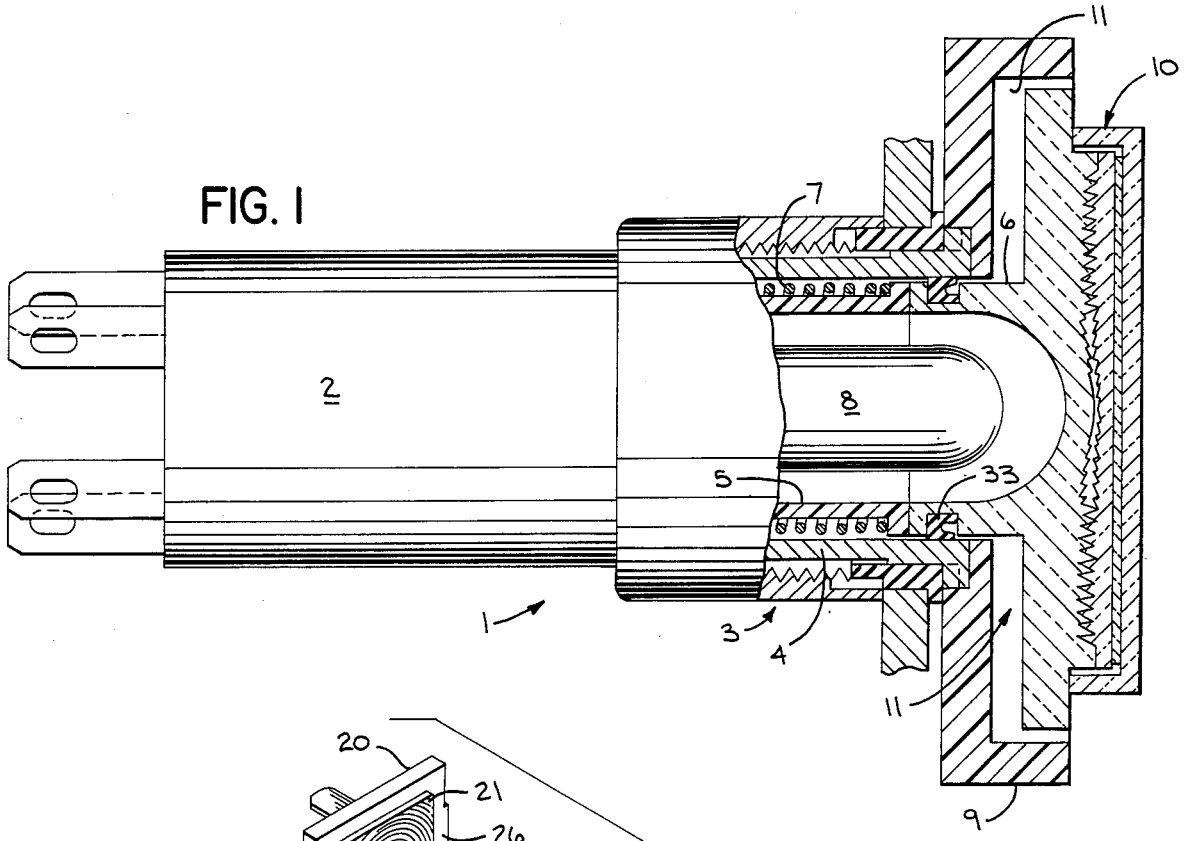
FIG. 1 is a view in cross section with parts shown in whole of a push button switch which employs the indicator light assembly of the present invention.

Referring particularly to FIG. 1, the indicator light assembly of the present invention forms part of a push button switch 1 which includes a contact block section 2 and an actuator section 3. The actuator includes a cylindrical mounting barrel 4 which supports a plunger 5 comprised of a lens cap 6 and a bias spring 7. When the plunger 5 is depressed, it slides rearward against the pressure of the bias spring 7 to operate switch contacts (not shown) in the actuator section 2.

A square bezel 9 is attached to the forward end of the mounting barrel 4, and when the plunger 5 is depressed, a square head 10 on the lens cap 6 is received in a square recess 11 defined by the bezel 9. A lamp 8 is mounted to the actuator section 2 and extends forward therefrom into the cylindrical bore formed through the plunger 5. The light produced by the lamp 8 travels forward through the lens cap 6 to illuminate its entire square-shaped head 10. For a more complete description of the push button switch 1, reference is made to co-pending PCT application serial No. PCT/US83/02029 which was filed on Dec. 21, 1983, and is entitled "Improved Push Button Switch and Pilot Light".

Figure 2:
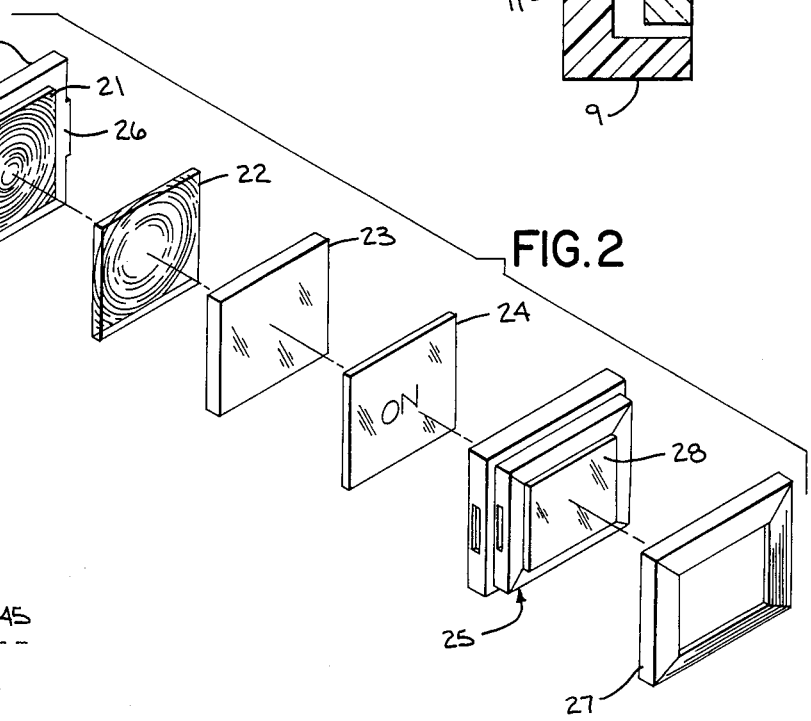
FIG. 2 is an exploded perspective view of the lens assembly which forms part of the switch of FIG. 1.

As shown best in FIG. 2, the lens cap 6 is comprised of a combination of molded plastic parts which snap together to form an integral unit. More specifically, the lens cap 6 includes a transparent molded plastic base member 20 that includes Fresnel lens 21 integrally molded to its front surface. A transparent, square, Fresnel plate 22 is disposed over the Fresnel lens 21, and a square, transparent color plate 23 overlies the plate 22. An indicia plate 24 overlies the color plate 23, and a transparent retainer cap 25 holds the lens cap elements together by snapping over a pair of tabs 26 formed on opposite sides of the base member 20. An opaque molded plastic frame 27 snaps to the front of the retainer cap 25 to provide an attractive outline for the square viewing surface 28 on the retainer cap 25.

The color plate 23 and the indicia plate 24 are optional elements which vary from application to application. The color plate 23 is tinted with a color and the indicia plate 24 supports a message, such as "ON", "OFF", "STOP", etc. The color and indicia can be combined in a single plate, or both plates 23 and 24 may be eliminated entirely.

Figure 3:
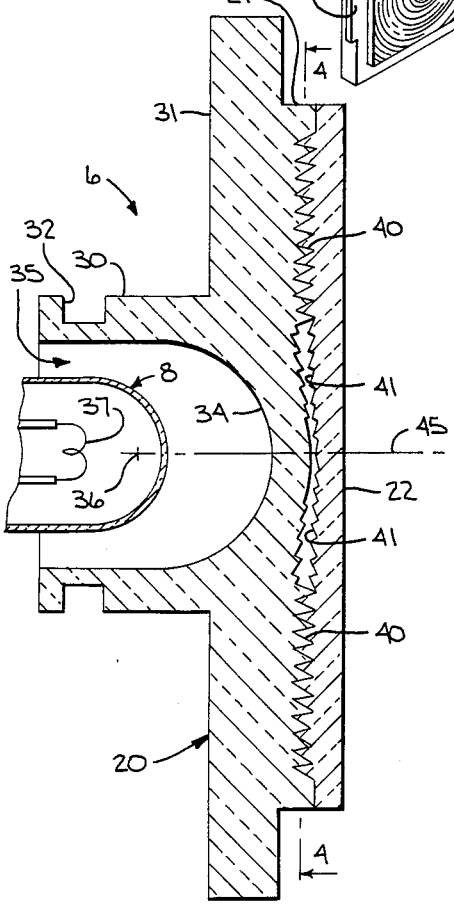
FIG. 3 is a partial view in cross section of the indicator light assembly which forms part of the switch of FIG. 1.

Referring particularly to FIGS. 3 and 4, the base member 20 has a circular cylindrical shaft 30 which is molded to the back surface of a square face plate 31. An annular groove 32 is formed around the outer surface of the shaft 30 to receive an elastomer seal 33 (FIG. 1), and the back surface of the face plate 31 is contoured to provide a concave lens 34 at the forward end of the space 35 defined by the shaft 30. The surface of the concave lens 34 is hemispherical in shape and it blends smoothly into the inner walls of the shaft 30. The focal point of the lens 34 is indicated at 36 and the lamp 8 is disposed in the space 35 with its filament 37 positioned behind this focal point 36.

As will be explained in more detail below, the light emanating from the filament 37 diverges as it passes through the concave lens surface 34. There are no discontinuities at the intersection of the inner surface of the shaft 30 and the surface of the concave lens 34 and due to the smooth, contoured surfaces in the space 35, very little light is reflected. The base member is constructed with a material having a relatively high index of refraction (typically 1.4 to 1.6) and in the preferred embodiment a transparent nylon sold under the trademark "ZYTEL" by DuPont Corporation is used.

Referring still to FIGS. 3 and 4, the Fresnel lens 21 is integrally molded to the front surface of the base member 20. The lens 21 is comprised of a series of concentric grooves, or rings 40 formed around the center of the face plate 31. As will be explained in more detail below, the rings 40 form prisms which refract and reflect the light passing through the face plate 31 from the concave lens 34, to thereby redirect the light and to diffuse the light.

The Fresnel plate 22 is constructed of the same material as the base member 20 and its back surface is contoured with a similar set of concentric rings 41. As will now be described in detail, the rings 41 on the Fresnel plate 22 also form prisms which refract and reflect the light in cooperation with the prisms on the face plate 31.

Referring particularly to FIG. 5, the indicator light assembly includes three optical surfaces which cooperate to produce an even illumination over the entire surface of the Fresnel plate 22. The light emanating from the lamp filament 37 is represented schematically as light rays R1 through R6, and these rays immediately engage the first optical surface, the concave lens surface 34. As illustrated, the concave surface insures that the angle of incidence of the rays R1–R6 is relatively small, thus minimizing the amount of light which is reflected from the surface 34. In addition, because the index of refraction of the base member 20 is substantially greater than "1", the light rays R1–R6 diverge as they pass through the first optical surface 34. Since the focal point 36 of the diverging rays R1–R6 is substantially forward of the lamp filament 37, the light indicated by ray R6 is able to reach the outer periphery of the Fresnel lens 21.

The rings 40 in the Fresnel lens 21 form the second optical surface and the rings 41 in the Fresnel plate 22 form the third optical surface. The purpose of the second and third optical surfaces is to alter the divergent light rays received from the first optical surface 34 into a confined bundle of rays R1'–R6' which are directed substantially parallel to the central axis 45 of the switch. Due to the extremely small dimensions of the prisms formed by the rings 40 and 41 and to manufacturing tolerances, it is not possible to reconverge the rays R1'–R6' into the narrow beam which is illustrated. Instead, the imperfections in the prisms formed by the rings 40 and 41 perform the important function of scattering, or diffusing, the light to provide a wide viewing angle for the light emanating from the assembly.

The prisms formed by the grooves 40 and 41 are of two types. The prisms toward the center, within the dimension "L" are dioptric prisms and those outside this dimension are catadioptric prisms. Dioptric prisms are commonly employed in the central region of lenses where the degree of light bending is within the capability of the refractive index of the lens material. The higher the refractive index, the farther out from the central axis 45 this type of prism may be used. This type of prism relies on refraction at the surfaces formed by the grooves 41 to columnate the light rays R1'–R3', and when the angle becomes too great, light is reflected off these surfaces and the efficiency of the lens assembly is reduced.

The catadioptric prisms formed by the grooves 40 and 41 begin a the radius "L" and extend outward to the periphery of the Fresnel lens 21 and Fresnel plate 22. These prisms rely on a combination of refraction and total internal reflection to bend the light rays R4–R6 into a column. The prisms formed by the grooves 40 and 41 mate with each other over this portion of the lens assembly and the surfaces of the prisms are substantially parallel to each other. However, a small air gap is present between the surfaces 40 and 41 which is not shown in the drawings.

The three optical surfaces described above serve to uniformly illuminate the entire front surface of the Fresnel plate 22. As shown in FIG. 2, this light then passes through the color plate 23, the indicator plate 24 and through the transparent, square viewing surface 28 on the retainer cap 25. Very little of the light is reflected and lost internally, and thus, a substantial amount of useful light is delivered to the eye of an observer standing in front of the push button switch.

It should be apparent that the indicator light assembly of the present invention may be employed separately as a pilot light, or it may be used in connection with other electrical components.

We claim:

1. In an indicator light assembly; a housing; a lamp disposed within said housing to emit light when energized; the improvement comprising a concave lens in alignment with said lamp for receiving the light rays from said lamp and diverging them; a second lens disposed to receive the diverging rays from said concave lens and redirect them into parallel rays to form a column of light and a viewing lens for receiving the light rays emanating from said second lens.

2. An indicator light assembly according to claim 1 wherein said lamp includes a filament; and the focal point of said concave lens is located forward of said filament so that it is disposed between said filament and said concave lens.

3. An indicator light assembly according to claim 1 including a plunger slidably supported in said housing for opening and closing contacts of a switch; an axial bore formed in said plunger and adopted to receive said lamp; and a concave wall closing one end of said axial bore to form said concave lens.

4. An indicator light assembly according to claim 3, including a base member secured to said plunger at the end having said concave lens, and presenting a surface on the side opposite its securement to said plunger; a plurality of concentric grooves formed in said surface to create a plurality of optical prisms; a plate presenting a surface; a plurality of concentric grooves formed in the surface of said plate to form a plurality of optical prisms; and means securing said plate to said base member so that its prisms cooperate with the prisms formed in said base member to columnate the diverging rays of light emanating from said concave lens and diffuse the columnated light.

5. An indicator light assembly according to claim 4 wherein the prisms formed in the central portions of both said base member and said plate are dioptric prisms while the prism formed in the outer portions of both said base member and said plate are catadioptric prisms.

* * * * *